US005245920A

United States Patent [19]

Hess

[11] Patent Number: 5,245,920

[45] Date of Patent: Sep. 21, 1993

[54] METHOD OF CALENDERING A PAPER WEB

[75] Inventor: Harald Hess, Grunkraut, Fed. Rep. of Germany

[73] Assignee: Sulzer Escher Wyss GmbH, Ravensburg, Fed. Rep. of Germany

[21] Appl. No.: 691,010

[22] PCT Filed: Nov. 7, 1989

[86] PCT No.: PCT/DE89/00701

§ 371 Date: Jun. 20, 1991

§ 102(e) Date: Jun. 20, 1991

[30] Foreign Application Priority Data

Dec. 22, 1988 [CH] Switzerland ..... 4741/88-2

[51] Int. Cl.[5] ..... B30B 15/34; D21G 1/00

[52] U.S. Cl. ..... 100/38; 100/35; 100/73; 100/90; 100/93 RP; 162/206; 162/207; 427/361; 427/366; 427/398.4

[58] Field of Search ..... 100/35, 38, 73, 74, 100/90, 93 RP; 427/326, 361, 366, 398.1, 398.2, 398.4; 162/206, 207

[56] References Cited

U.S. PATENT DOCUMENTS

| | | | |
|---|---|---|---|
| 2,636,833 | 4/1953 | Borden, Jr. | 427/366 |
| 3,153,378 | 10/1964 | Nelson | 100/38 |
| 3,841,963 | 10/1974 | Schlunke | 100/93 RP X |
| 4,277,524 | 7/1981 | Nakajima et al. | 427/366 X |
| 4,370,923 | 2/1983 | Schmidt | 100/93 RP X |
| 4,606,264 | 8/1986 | Agronin et al. | 100/38 |
| 4,738,197 | 4/1988 | Mälkiä | 100/38 |

FOREIGN PATENT DOCUMENTS

| | | | |
|---|---|---|---|
| 225019 | 12/1962 | Austria | 100/90 |
| 3542342 | 6/1986 | Fed. Rep. of Germany . | |
| 3600033 | 7/1986 | Fed. Rep. of Germany . | |
| 2325764 | 4/1977 | France . | |
| 100719 | 1/1941 | Sweden | 100/74 |

*Primary Examiner*—Stephen F. Gerrity
*Attorney, Agent, or Firm*—Sandler Greenblum & Bernstein

[57] ABSTRACT

The calendering occurs in a press nip of a calender with application of pressure, moisture and heat. To achieve a desired surface quality, the surface of the paper or cardboard web which is to be calendered is brought in the press nip to a condition above the glass transition curve of the materials. Prior to expiration of 20 to 60 milliseconds, the surface of the paper web departing from the press nip is subjected to a transition step by virtue of a cooling device first in combination with a change in moisture content to a condition beneath the glass transition point of the material. The cooling can occur during contact of the surface to be cooled with a cooled surface or by direct contact with a cooling, preferably inert gas. After calendering there thus arises a diminished increase in the roughness of the paper web, so that the surface quality obtained in the press nip is predominantly retained. There have been illustrated suitable apparatuses for carrying out the method.

12 Claims, 2 Drawing Sheets

FIG. 1
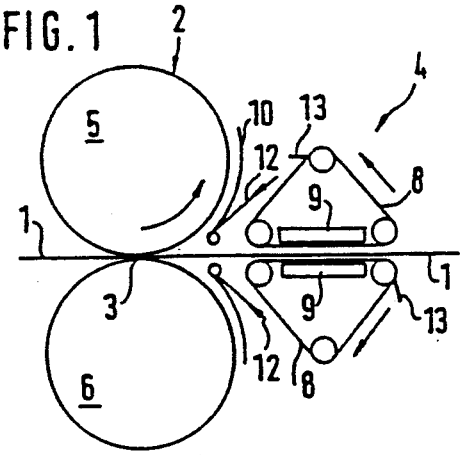
FIG. 2
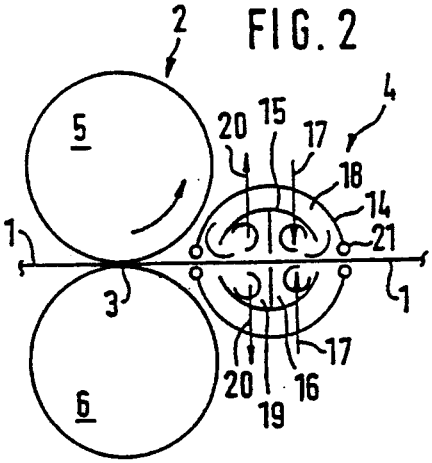
FIG. 3
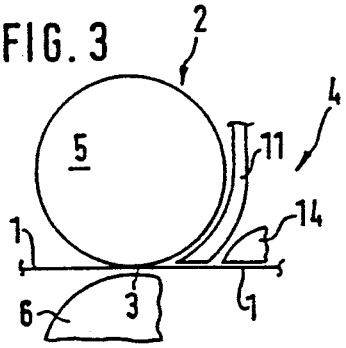
FIG. 4
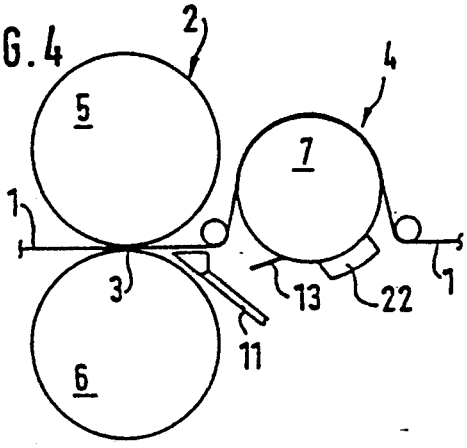
FIG. 5
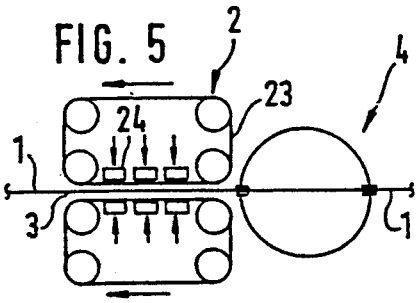
FIG. 6
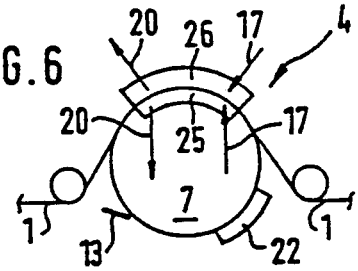
FIG. 7
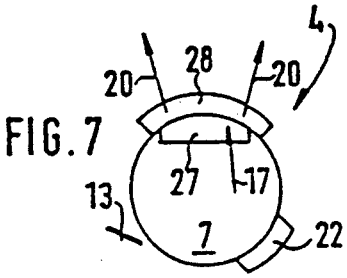
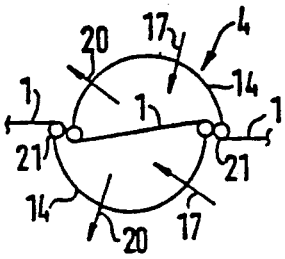
FIG. 16
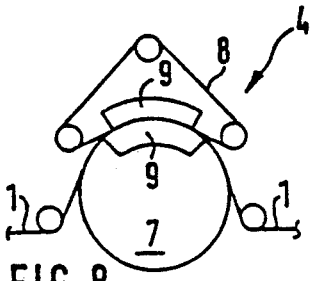
FIG. 8

METHOD OF CALENDERING A PAPER WEB

BACKGROUND OF THE INVENTION

1. Field of the Invention

The present invention relates to a method of calendering a paper web or cardboard web by applying pressure, moisture and heat in a press nip.

2. Description of Background and Relevant Information

During the calendering of paper or cardboard it is known that the structure achieved in the press nip of the calender alters after departure of the paper web from the press nip. There thus occurs a change in the paper web, whereby the desired smoothness of the surface which has already been attained in the press nip again decreases, that is to say, the roughness of the surface increases. This occurs because of a more or less pronounced and localized varying re-swelling, and specifically, especially in the presence of calender temperatures in the press nip which are beneath the glass transition point (i.e., the plastification temperature) of the material to be calendered.

A reduction in the smoothness is usually also then observed when the calendering temperatures in the press nip are above the glass transition point and the paper web, following departure from the press nip, gradually cools at the ambient temperature below the glass transition temperature of the material. One speaks of the paper "working".

Frequently, the optimum surface characteristics of the calendered paper or cardboard desired for the further processing, such as for imprinting or inscribing and so forth, as described in German Patent Publication No. 3,600,033, only can be obtained with high temperatures of the surfaces of the employed rolls of the calender or only with high temperatures in the press nip, respectively.

In many cases it is recommended to heat the paper or cardboard web at least at its surface layers above the glass transition temperature, in order to here attain the plastification of the material. After departure from the press nip the warm web gradually again thermodynamically comes into equilibrium with the surroundings, that is, the differences in the temperature and moisture content are compensated in equilibrium with the surroundings. In so doing, the material "works", and that much more intensively the greater the starting temperature of the web. This is a known long-time effect, wherein the micro-roughness of the smoothed surface can again increase. The mentioned elastic re-swelling additionally occurs, and the non-plasticized inner layers of the web increase in thickness in relation to the condition in the press nip. This is a known short-time effect which is completed after about 100 ms to 2 minutes following departure of the web from the press nip. This re-swelling is locally different. It is particularly pronounced at locations of greater compression, such as, for example, locations containing fiber flocks or locations possessing greater surface weight in the web. Consequently, there likewise arises an increase in roughness at the fiber flock region after calendering, i.e., "macro-roughness".

All of this can have the consequence that for achieving a desired high surface smoothness of the paper web the calendering operation must be carried out a number of times in succession, for example, in a number of press nips with varying calender conditions as concerns the pressure, the moisture content of the paper web and the temperature, or the operation must occur more slowly or with greater line force.

According to past experience the following enumerated operating parameters enhance the operation in which the paper web located in the press nip of the calender at a temperature above the glass transition point of the material should be brought below the glass transition point of the material following the departure from the press nip of the calender:

(a) If the paper web to be calendered is thick, that is, has a high surface weight, then the thermal energy taken up in the press nip is removed in the interior of the web, and there occurs a rapid cooling of the surface provided that higher temperatures prevail in the surface layers than in the interior of the web and the mean temperature is below the glass transition temperature;

(b) If there is present a corresponding high web moisture content, then the paper web, following departure from the press nip, is cooled by the cold due to vaporization, especially if the paper web is heated in the press nip above 100° C;

(c) If the degree of crystalinity of the material is high, and thus, also the glass transition temperature in the paper web, so that then with great temperature difference between the paper web and the surroundings there occurs a high dissipation of heat associated with a rapid temperature drop of the paper web beneath the glass transition temperature.

If these prerequisites which are favorable for cooling of the paper web after calendering are not present or have not been attained for technical reasons or can not be attained, there is again lost the quality of the surface obtained, if necessary, in the press nip of the calender or both of the surfaces of the paper web, respectively, due to re-swelling, and here, in particular, due to local different re-swelling, and thus also due to an increase in the macro-roughness, but also due to an increase of the micro-roughness.

SUMMARY OF THE INVENTION

The invention is concerned with the object of finding a method of calendering a paper or cardboard web of the above-mentioned type, which renders it possible to at least partially maintain the quality of the calendered surface and the surfaces of the paper web, respectively, which have been achieved in the press nip of the calender following departure of the paper web from the press nip of the calender. There should be at least minimized an increase in the roughness of the already smoothed surfaces.

This object is solved according to the invention by measures which are set forth in the present disclosure.

More specifically, the present invention includes a method of calendering a paper or cardboard web in a calender while applying pressure, moisture and heat in a press nip of the calender for achieving a desired surface quality at the calendered paper web, wherein at least the surface of the paper or cardboard web to be calendered, during calendering in the press nip is treated at a temperature above the glass transition point of the material, wherein, following departure of the paper or cardboard web out of the press nip prior to expiration of a time interval of about 20 to 60 milliseconds, the calendered surface of the paper web is intentionally subjected to a transition step at a temperature and moisture content beneath the glass transition point of the material.

Due to the intentional deliberate cooling possibly with parallelly occurring lowering of the moisture content of the paper or cardboard web, which is carried out practically directly after departure from the press nip, the structure which is obtained in the press nip of the calender, in other words, the quality of the surface is "frozen", and thus, at least partially maintained. There is realized a thermodynamically stabilized condition beneath the glass transition curve, and due to the forced "freezing" or solidification of the surface layers, especially due to preventing deformation, there is counteracted the more pronounced elastic re-swelling at locations of greater surface weight but also an increase in the micro-roughness.

Consequently, there is attained a greater degree of calendering. There can be dispensed with a repetition of the calendering operation or the operation can be carried out more rapidly or with lesser line forces. As a result, there is realized a savings in machinery and energy in contrast to what was previously required. If the operation is carried out more quickly, then the production increases.

According to a particular embodiment of the invention, the transition step is undertaken by means of a cooling device which is arranged at the outlet of the paper web from the press nip.

According to an additional embodiment of the invention, the transition step is accomplished by heat-exchanging contact of the surface of the paper or cardboard web which is to be cooled with a cooled surface to which there is guided the paper or cardboard web.

According to a still further embodiment of the invention, the transition step is at least partially accomplished by suctioning off the vapor which is formed upon departure of the paper web out of the press nip.

According to a still further embodiment of the invention, the transition step is accomplished by direct features that the transition contact of the surface of the paper web which is to be cooled with a cooling gas.

According to a still further embodiment of the invention, the transition step is accomplished with an inert gas.

According to a still further embodiment of the invention, the gas is blown onto the paper web and sucked through the paper web.

According to a still further embodiment of the invention, the paper web is pre-heated and/or moistened prior to entry into the press nip.

BRIEF DESCRIPTION OF THE DRAWINGS

In the following there will be more fully described and explained the subject of the invention and the thus realizable advantages. The description is based upon a drawing in which there are schematically shown:

FIG. 1 to FIG. 8, which respectively illustrate examples of apparatuses for performance of the inventive method;

FIG. 16, which illustrates a special form of the sealing.

DETAILED DESCRIPTION OF THE PREFERRED EMBODIMENTS

Figure 9:
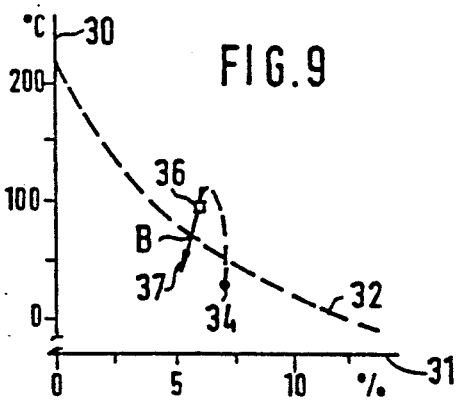
FIG. 9 to 15, which graphically illustrate examples of the method.

The paper web 1 to be calendered is guided in a calender 2. In the press nip 3 between the rolls 5 and 6, at least one of which is heated, there occurs the calendering of the paper web in known manner with application of pressure, moisture and thermal energy. The heating is performed in such a way that at least one surface of the paper web is heated through contact with a heated surface to a temperature which lies above the glass transition point of the material to be calendered, and which is computed such that the mean web temperature, following the transition step, lies below the glass transition temperature, and advantageously internally of the paper web the temperature should remain beneath the glass transition point. In this way there is achieved in the press nip a certain structure, a desired quality of the surfaces of the paper web 1. After its departure from the press nip 3, the paper web prior to expiration of a time span of approximately 20 to 60 milliseconds (ms.), is subjected to a transition step by means of a cooling device 4, and at least one smoothed surface of the paper web is cooled to a temperature beneath the glass transition point of the material. By virtue of this transition of at least the surfaces of the paper web 1, which occurs practically directly prior to the expiration of 20 to 40 ms., there is practically retained its structure which has been smoothed in the press nip 3 and its desired quality.

There hardly occurs a re-swelling of the web which damages the surface quality and, also, there is no roughness increase at the calendered surfaces of the web.

In order to attain a temperature desired for calendering in the press nip 3 and a desired moisture content of the web 1, it is advantageous in certain cases to appropriately heat the web 1 prior to entry into the press nip 3 and/or to correct its moisture content.

The transition step is performed by means of a cooling device 4 which is arranged at the exit of the paper web 1 from the press nip 3. Since in the case of, for example, FIG. 1, there is of concern calendering of both sides of the paper web 1, the cooling device 4 is constructed as a mirror image with respect to the paper web 1 It possesses in each case an endless good heat-conducting belt 8 which revolves at the same velocity as the velocity of the paper web 1 and in the same direction. Cooling bodies 9 are provided at the belt 8. During operation, the paper web 1 is guided between the belts 8, and its surfaces, during conducting of a cooling medium through the cooling bodies 9 in contact with the cooled surfaces of the belts 8, are cooled.

Screening walls 10 are advantageously provided at the heatable rolls 5 and/or 6, which should prevent radiation and convection of their thermal energy at least in the direction of the cooling device 4. The vapor, which escapes upon departure of the paper web from the press nip, can be advantageously withdrawn or sucked-up, respectively, through the intermediate spaces between the rolls and the screening walls 10. A correspondingly intensive suction withdrawal of this vapor can be understood as the first stage of the cooling step with respect to the departing paper web 1. This first step also can be initiated by a suction conduit 11 separately provided for this purpose, the arrangement of which has been particularly shown in FIG. 3. In the presence of technological prerequisites which are favorable for this purpose, as concerns the temperature and the moisture content of the paper web 1 to be calendered, this first stage already can be sufficient for rapid attainment of a condition beneath the glass transition point due to evaporation of the moisture and the thus accomplished cooling of the paper web 1, and thus, can be sufficient for the stabilization of the calendered quality achieved in the press nip. Scrapers 13 are arranged at the belts 8 for the removal of the condensation moisture.

The paper or cardboard web 1 also can be transformed by direct contact of its surfaces with a cooling gas. Nozzles 12 can be advantageously arranged at the outlet of the press nip 3 in order to achieve starting of the cooling step as soon as possible, which serve for blowing a cooling gas upon the surfaces of the paper web 1.

FIG. 2 illustrates a further example of a cooling device 4 suitable for this purpose. Also, this cooling device can be designed as a mirror image with respect to the paper web 1 and thus can be effective at both of its surfaces. It comprises a hood 14 and intermediate walls 15 which delimit spaces which are open with respect to the paper web 1. A cooling gas is conducted by means of an infeed conduit 17 into a space 16, guided through a subsequent space 18 into a space 19 which is open with respect thereto and withdrawn therefrom by means of a removal conduit 20.

In this manner, the cooling gas comes into direct contact with the paper web 1, since the spaces 15, 18 and 19 are open in each case towards the paper web 1. Seals 21, for instance, sealing rolls or immersion ledges, approximately like shown in FIGS. 2 or 16, are provided at the inlet and outlet of the paper web 1 with respect to the hood 14, in order to prevent as far as possible the loss of cooling gas. In order to avoid oxidation which, for instance, can result in undesired loss of the degree of whiteness of the paper web, it is recommended to use for cooling an inert gas, such as nitrogen or carbon dioxide.

With the examples of FIGS. 3 and 4 there is of concern calendering at one side, in other words, smoothing of predominantly one of the surfaces of the paper or cardboard web 1. In the example of FIG. 3, the upper roll 5 is heated, and the surface guided thereat is more intensively calendered. A cooling device 4 provided with a hood 14 is associated with this surface, just like also a suction device 11 for sucking up the vapor escaping upon exit of the paper web 1 from the press nip 3. In the example according to FIG. 4, the lower roll 6 is heated. The surface of the paper web 1 which is calendered at this roll is delivered to a cooled roll 7 for cooling. The vapor escaping upon departure of the paper web 1 from the press nip 3 is withdrawn by means of the suction device 11, with the result that there is accomplished a first transition step. An aeration device 22, which produces additional cooling due to vaporization, combined with a scraper 13, serves for the removal of condensate at the jacket of the cooling roll 7.

In FIG. 5 there is illustrated a calender 2 possessing endless belts 23 which can be driven at the same speed and in the same direction as the paper web 1. The application of pressure and the heating in the press nip 3 takes place by means of known pressing elements 24 possessing pressure pockets which are open in the direction of the belt 23, which are impinged with a heat-carrying medium. The approximately rectangular-shaped, space-saving guiding of the belts 23 allows for the arrangement of the cooling device 4 directly at the outlet of the paper web from the press nip 3.

A cooling of the paper web 1 by direct contact with a cooling gas also can be carried out by means of cooling devices 4, which are illustrated in FIGS. 6 and 7. The jackets of the rolls 7 are perforated. The cooling gas is blown by means of a distributor box 26 through the surface of the paper or cardboard web moving therepast, and after its passage through the paper web 1 this gas is suctioned off by means of a suction box 25 through the perforated jacket of the roll 7. These boxes 25 and 26 can be designed, for instance, in accordance with the cooling device 4 previously described with respect to FIG. 2 in the sense of a counter flow-cooling or unidirectional flow-cooling and accordingly are connected in each case with an infeed conduit 17 and outfeed conduit 20, respectively, for the cooling gas. In the embodiment according to FIG. 7, the cooling gas is blown by means of a distributor box 27 through the perforations of the roll 7 onto the surface of the paper web 1 moving therepast. The gas is delivered to the distributor box 27 by means of an infeed conduit 17 and removed from the suction box 28 by means of a withdrawal conduit 20. The guiding of the gas from the outside towards the inside is usually more advantageous, so that the outer box thus serves as distributor and the inner as suction box. In each case an aeration device 22 and a scraper 13 for removal of the condensate from the surface of the jacket of the roll 7 are arranged at the perforated jackets of the rolls 7.

A cooling device 4, according to FIG. 8, has a cooling roll 7, the jacket of which is cooled by means of a cooling body 9. The cooling takes place in a circular segment-shaped gap between the jacket of the roll 7 and an endless belt 8 driven at the same speed and to move in the same direction as the jacket of the roll 7, which partially wraps about the jacket.

As results from what has been previously stated, with the inventive method the following measures are employed individually or in combination:

(A) Pre-treatment of the paper web 1 prior to its entry into the press nip 3 of the calender by heating and/or moistening the surfaces of the web. Consequently, if necessary, the attainment or exceeding, respectively, of the glass transition temperature of the material in the heated press nip 3 is augmented or even rendered possible. Advantageous technical possibilities for this purpose constitute, for example, surface moistening with vapor, with water nozzles, with water scrapers, by applying a water film by rolls, or pre-heating through contact with forwardly arranged heating rolls, with vapor, with tempered water, with IR-radiation, microwaves or in a heated press nip, especially an extended press nip as shown, for instance, in FIG. 5.

(B) Intentional reduction of the moisture by evaporation in the press nip 3 (contact of the paper web with heated rolls or belts) and cooling due to vaporization. By vaporizing at least a portion of the web moisture due to the employed temperature in the press nip 3 and due to the therewith associated and parallel occurring web cooling due to vaporization directly following the press nip 3, there can be attained, starting with a condition above the glass transition curve, a condition beneath the glass transition curve. This procedure can take place both in a press nip 3 between calender rolls (see FIGS. 1 to 4) as well as also between calender belts (see FIG. 5).

(C) Intentional cooling of the paper web practically directly prior to expiration of about 20 to 60 ms. after departure from the press nip 3 of the calender from a temperature above the glass transition curve to one beneath the glass transition curve. This can occur, for instance, by evaporation of the moisture of the web or additionally sprayed on liquid, such as liquid nitrogen or liquid air, alcohol, acetone or ketone and by suctioning-off the vapors, through contact with cold liquid, for example, water, through contact with an ice ledge, for example, formed of carbon dioxide ice or water ice or by using one of the cooling devices 4 described by way of example in conjunction with FIGS. 1 to 8.

Figure 12:
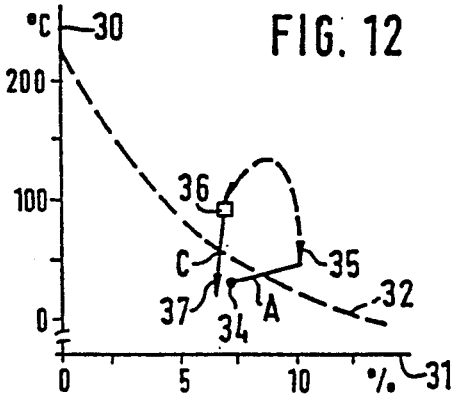

Depending upon the employed method the moisture content is thus reduced increased or remains unchanged (FIG. 12, 15)

With all of the measures A, B or C described above which are employed individually or in combination, care must be taken in each case to ensure that there is exceeded the glass transition temperature in the press nip 3, and that parallel to cooling beneath the glass transition temperature the moisture content assumes the technologically desired value and preferably corresponds thermodynamically to the equilibrium moisture (relative to the surroundings).

In FIGS. 9 to 15 there have been graphically illustrated the course of the measures A, B and C, respectively, individually or in possible combinations. In the Figures they are designated by:

30 the temperature coordinate,

31 the moisture content coordinate,

32 the glass transition curve of cellulose and house cellulose, and

33 the glass transition curve of lignin in each instance at a crystalinity of 60%.

The course of the individual steps of the measures has been designated in each case by reference characters A, B or C, and there have been illustrated the temperature ascent, the cooling and the moisture content changes. In each case reference numeral 34 designates the starting point before the press nip 3, reference numeral 35 the inlet point into the press nip 3, reference numeral-36 the exit point out of the press nip 3, and reference numeral 37 the terminal condition following cooling and reduction of the moisture content of the paper web.

In the embodiment of FIG. 9, the heating occurs only in the press nip 3 and the cooling only through the cold due to vaporization of the inherent moisture content of the paper web 1 without pre-heating thereof and without pre-moistening prior to entry into the press nip 3 (measure B).

Figure 10:
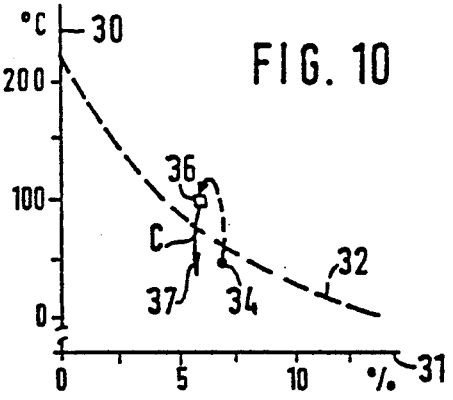

In the embodiment of FIG. 10, the heating occurs only in the press nip 3 without pre-heating and pre-moistening, and the cooling, however, occurs due to the transition step 4 directly 5 after the exit of the paper web 1 from the press nip 3 (measure C).

Figure 11:
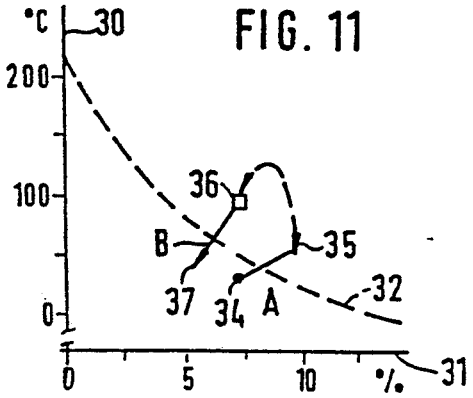

In the embodiment of FIG. 11, the heating occurs only in the press nip 3 following prior pre-heating and pre-moistening and the cooling only due to the cold of vaporization of the moisture 10 of the paper web 1 (combination of the measures A and B).

In the embodiment of FIG. 12, the heating occurs in the press nip 3 following prior pre-heating and pre-moistening and the cooling due to the transition step 4 directly after departure of the paper web 1 from the press nip 3 (combination of the measures A and C).

Figure 13:
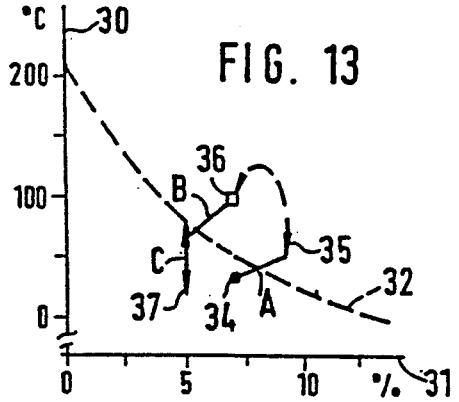

In the embodiment of FIG. 13, the heating occurs in the press nip 3 following pre-heating cooling occurs partially due to the cold vaporization of the moisture of the paper web 1 and due to the transition step 4 directly after departure of the paper web 1 from the press nip 3 (combination of the measures A, B and C).

Figure 14:
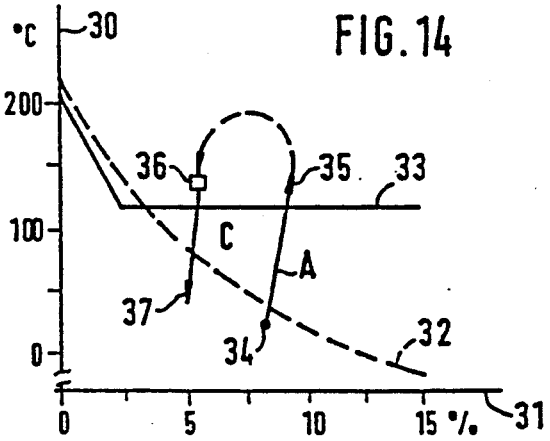
Figure 15:
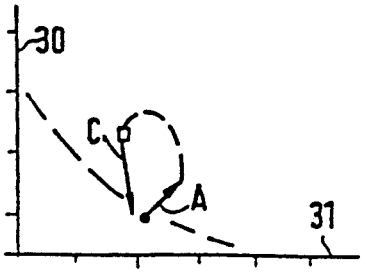

The embodiment depicted in FIG. 14 relates to the case where there is exceeded both the glass transition temperature of the cellulose or the house cellulose, respectively, as well as also the glass transition temperature of the lignin in the paper web upon performing the inventive method. After pre-heating and pre-moistening forwardly of the press nip 3, the paper web is calendered in the press nip 3 at a temperature above the higher lying glass transition temperature of the lignin. The cooling is accomplished by utilizing the cooling step 4 (combination of the measures A and C). In analogous manner there also can be conceivably used in this case the measures B or C or combinations of the measures A and B or A, B and C.

I claim:

1. Method of treating a paper or cardboard web in a calender for achieving a desired surface quality of the calendered paper web, said method comprising the steps of:

calendering a surface of the paper or cardboard web by moving the paper or cardboard web through a press nip of a calender;

heating at least the surface of the paper or cardboard web to be calendered, during calendering in the press nip, at a temperature above the glass transition point of the web material; and subjecting at least the calendered surface of the paper or cardboard web to a temperature and to a moisture content below the glass transition point of the web material before the elapse of about 20 to 60 milliseconds following departure of the paper or cardboard web from the press nip.

2. The method according to claim 1, wherein the step of subjecting is performed by means of a cooling device arranged at the outlet of the paper web from the press nip.

3. The method according to claim 1, wherein the step of subjecting is performed by heat-exchanging contact of the calendered surface of the paper or cardboard web with a cooled surface to which there is guided the paper or cardboard web.

4. The method according to claim 1, wherein the step of subjecting is at lest partially performed by suctioning off vapor which is formed upon departure of the paper web from the press nip.

5. The method according to claim 1, wherein the step of subjecting is accomplished by direct contact of the surface of the paper web to be cooled with a cooling gas.

6. The method according to claim 5, wherein the step of subjecting is accomplished with an inert gas.

7. The method according to claim 5, wherein the cooling gas is blown onto the paper or cardboard web and withdrawn through the paper web.

8. The method according to claim 1, wherein the paper or cardboard web is at least pre-heated prior to entry to the press nip.

9. The method according to claim 1, wherein the paper or cardboard web is at least moistened prior to entry to the press nip.

10. The method according to claim 1, wherein the paper or cardboard web is at least pre-heated and moistened prior to entry to the press nip.

11. The method according to claim 1, wherein the step of calendering comprises calendering a surface of the paper or cardboard web by moving the paper or cardboard web through a press nip of a calender only once, whereby the method is completed at a temperature and a moisture content below the glass transition point of the web material.

12. The method according to claim 1, wherein the steps of calendering, heating and subjecting are performed with there being no coating on the surface of the paper or cardboard web that is calendered.

* * * * *